US008973175B2

(12) United States Patent
Green

(10) Patent No.: US 8,973,175 B2
(45) Date of Patent: Mar. 10, 2015

(54) BIODEGRADABLE TOILETRY APPARATUS AND METHOD

(76) Inventor: Valiant Green, Columbia Heights, MN (US)

( * ) Notice: Subject to any disclaimer, the term of this patent is extended or adjusted under 35 U.S.C. 154(b) by 743 days.

(21) Appl. No.: 13/165,447

(22) Filed: Jun. 21, 2011

(65) Prior Publication Data

US 2012/0324640 A1 Dec. 27, 2012

(51) Int. Cl.
*A47K 13/14* (2006.01)
*B31C 1/00* (2006.01)

(52) U.S. Cl.
CPC .. *A47K 13/14* (2013.01); *B31C 1/00* (2013.01)
USPC ..... 4/245.6

(58) Field of Classification Search
CPC ..... A47K 13/00; A47K 13/14
USPC ..... 4/245.1–245.9
See application file for complete search history.

(56) References Cited

U.S. PATENT DOCUMENTS

| | | | | | |
|---|---|---|---|---|---|
| 1,159,070 | A * | 11/1915 | Munch | 4/245.5 |
| 1,635,072 | A * | 7/1927 | De Luna | 4/245.3 |
| 3,102,276 | A * | 9/1963 | Warnberg | 4/245.5 |
| 4,589,149 | A * | 5/1986 | Bassi | 4/245.5 |
| 5,243,779 | A * | 9/1993 | Reed | 43/43.12 |
| 5,437,906 | A * | 8/1995 | Snuggs | 428/131 |
| 5,745,929 | A * | 5/1998 | Sobieralski | 4/245.1 |
| 5,887,291 | A * | 3/1999 | Bellizzi | 4/245.5 |
| 6,783,826 | B2 * | 8/2004 | Sherrod et al. | 428/35.7 |
| 7,214,414 | B2 * | 5/2007 | Khemani et al. | 428/34.3 |
| D605,262 | S * | 12/2009 | Rodgers | D23/311 |
| 7,854,028 | B1 * | 12/2010 | Williams | 4/245.6 |
| D653,319 | S * | 1/2012 | Eaddy | D23/311 |
| 2011/0067171 | A1 * | 3/2011 | Kouadio | 4/245.1 |

OTHER PUBLICATIONS

Sani-Seat Toilet Seats® Online Marketing Brochure. North American Hygiene, Inc. Retrieved from www.cleanseats.com on May 6, 2011 1 page.

Surrao et al. "Self-Crimping, Biodegradable, Electrospun Polymer Microfibers,"Biomacromolecules 2010, 11, 3524-3629. 6 pages Published on the Web Nov. 3, 2010.

* cited by examiner

*Primary Examiner* — Lori Baker
(74) *Attorney, Agent, or Firm* — Stuart R. Hemphill; Dorsey & Whitney LLP

(57) ABSTRACT

A seat cover comprises a sheet of biodegradable material wound about itself so as to define a hollow core, with the hollow core having an interior perimeter sufficiently large so as to fully encompass a toilet seat about a trans-axial perimeter thereof when inserted thereover. A seat cover also may comprise a plurality of biodegradable balls connectedly associated with a substrate, wherein the substrate has substantially the shape of a toilet seat. A method of making a seat cover comprises winding a sheet of biodegradable material about an object having a trans-axial perimeter about the same size as a toilet seat, wherein a wind partially overlaps a preceding wind such that winding progresses in an axial direction along the object with each successive wind, and removing the wound sheet from the object. A method of making a seat cover also comprises connectedly associating a plurality of biodegradable balls to a substrate along an exterior surface thereof, wherein the substrate has the shape of a toilet seat.

21 Claims, 3 Drawing Sheets

BIODEGRADABLE TOILETRY APPARATUS AND METHOD

TECHNICAL FIELD OF THE DISCLOSURE

The present disclosure relates to toiletry products and methods of use thereof. More specifically, the present disclosure relates to an environmentally friendly, bio-degradable protective toilet seat cover.

BACKGROUND OF THE RELATED ART

Personal care products such as toiletries, moist and dry wipes, toilet paper, sanitary cushions, protective toilet seat covers, and the like, are conventionally made in large part from synthetic polymer materials, including significant portions of which that are not or cannot be recycled after use.

Manufacturers, retailers, and consumers of personal care products recognize a need to address environmental concerns. One slogan used to promote environmental awareness and sustainability is reduce, reuse, and recycle. Current personal care product schemes, however, cannot meet these goals.

For example, the Sani-Seat® toilet seat, manufactured by North American Hygiene, Inc., uses a high density polyethylene material, which is not biodegradable, and therefore is not suitable for single-use applications in an environmentally friendly manner. Other similar systems are known in the art, such as U.S. Pat. No. 5,887,291, to Bellizzi.

An opportunity exists to create environmentally friendly toiletry products to help reduce non-biodegradable waste. What is needed, therefore, is an environmentally friendly, bio-degradable protective toilet seat cover suitable for single-use applications.

BRIEF SUMMARY OF THE DISCLOSURE

In one embodiment, disclosed herein is a seat cover that may include a sheet of biodegradable material wound about itself so as to define a hollow core. The hollow core may have an interior perimeter sufficiently large so as to fully encompass a toilet seat about a trans-axial perimeter thereof when inserted thereover. In variations of this embodiment, the biodegradable material may be a plant-based fiber material. The biodegradable material may be toilet paper. The sheet may be wound in a substantially trans-axial direction with respect to the length of the toilet seat. A wind of the wound sheet may partially overlap a preceding wind. There may be a plurality of partially overlapping winds so as to give the cover a length in an axis direction. Further, the length may be sufficiently long to substantially cover the toilet seat along its axial length.

In another embodiment, disclosed herein is a seat cover that may include a plurality of biodegradable balls connectedly associated with a substrate, wherein the substrate has substantially the shape of a toilet seat. In variations of this embodiment, the biodegradable balls may be a plant-based fiber material. The biodegradable balls may be cotton balls. The substrate may two dimensional and configured for placement atop the toilet seat. Alternatively, the substrate may be three dimensional and configured for insertion over a toilet seat. The substrate may be made of a biodegradable material. The balls may be positioned in abutting adjacency with respect to one another along the exterior surface of the substrate.

In yet another embodiment, disclosed herein is a method of making a seat cover that may include winding a sheet of biodegradable material about an object having a trans-axial perimeter about the same size as a toilet seat, wherein a wind partially overlaps a preceding wind such that winding progresses in an axial direction along the object with each successive wind, and removing the wound sheet from the object. In order to use the seat cover, the wound sheet may be inserted over a toilet seat so as to cover the toilet seat fully about a trans-axial perimeter thereof. In variations of this embodiment, the sheet of biodegradable material may be toilet paper. The object may be a human arm.

In still another embodiment, disclosed herein is a method of making a seat cover comprising connectedly associating a plurality of biodegradable balls to a substrate along an exterior surface thereof, wherein the substrate has the shape of a toilet seat. In order to use the seat cover, the cover may be placed atop a toilet seat if the substrate has a two-dimensional form or inserted over a toilet seat if the substrate has a three-dimensional form. In variations of this embodiment, the balls may be cotton balls.

While multiple embodiments are disclosed, still other embodiments in accordance with the present disclosure will become apparent to those skilled in the art from the following detailed description, which shows and describes illustrative embodiments. As will be realized, the embodiments disclosed are capable of modifications in various aspects, all without departing from the spirit and scope of the present disclosure. That is, persons skilled in the art will recognize that changes may be made in form and detail without departing from the spirit and scope of the disclosure. Accordingly, the drawings and detailed description are to be regarded as illustrative in nature and not restrictive.

BRIEF DESCRIPTION OF THE FIGURES

While the specification concludes with claims particularly pointing out and distinctly claiming the subject matter for which patent rights are currently sought, it is believed that the embodiments disclosed herein will be better understood from the following description taken in conjunction with the accompanying Figures, in which:

DETAILED DESCRIPTION

Figure 1:
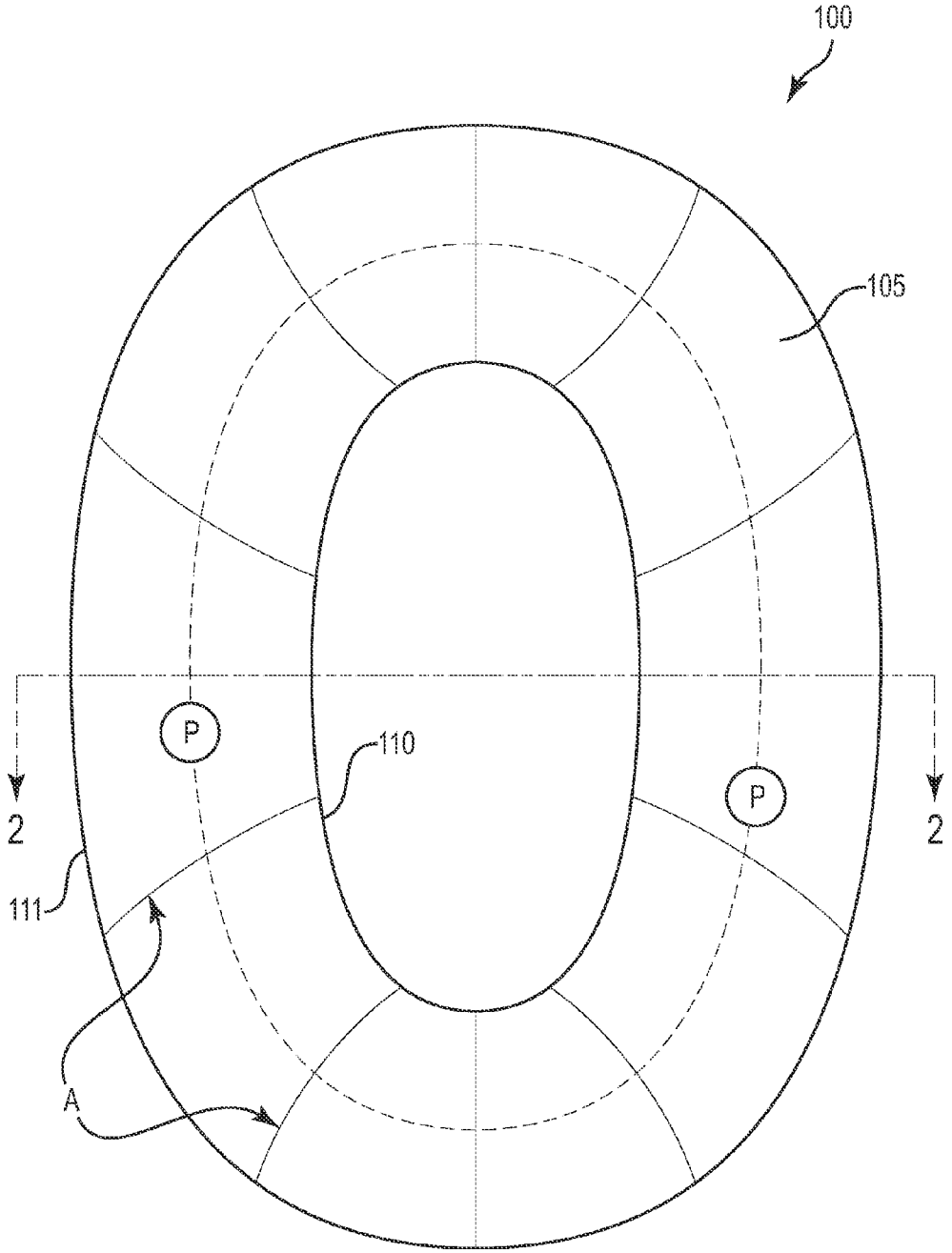
FIG. 1 illustrates a top view of a protective toilet seat cover in accordance with one embodiment disclosed herein.

With reference to FIG. 1, some embodiments of a biodegradable, protective toilet seat cover 100 may include a substantially bio-degradable material, which may be a fiber-based material, provided in sheet form 105. Suitable fiber-based materials include all types of plant-based materials, as plant-based materials are naturally biodegradable. For example, tree pulp, cotton, flax, hemp, and seaweed are suitable fibrous plants from which sheets of fiber-based material can be derived. There is also current research in the biological and environmental arts into synthetic fiber materials that are substantially biodegradable, for example S. C. Surrao et al., "Self-Crimping, Biodegradable, Electrospun Polymer Microfibers," Biomacromolecules (2010), 11, 3624-3629. Such synthetic, biodegradable fibrous materials are also intended to be included within the scope of the present disclosure.

Suitable sheets of fiber-based materials 105 are preferably provided having a generally consistent thickness and width along its length. However, it is conceivable that either dimension may be inconsistent along its length, while still being functional for the presently disclosed use. In some embodiments, the thickness of fiber-based material sheets may be about 0.01, 0.05, 0.1, 0.2, 0.3, 0.4, 0.5, 0.6, 0.7, 0.8, 0.9, 1., 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.5, 4, 4.5, 5, 6, 7, 8, 9, 10 or greater millimeters, or within any range of thicknesses thereinbetween. Sheets may be provided with one or more plies. In some embodiments, the width of fiber-based material sheets may be about 0.01, 0.05, 0.1, 0.2, 0.3, 0.4, 0.5, 0.6, 0.7, 0.8, 0.9, 1., 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.5, 4, 4.5, 5, 6, 7, 8, 9, 10 or greater decimeters, or within any range of widths thereinbetween. The length of such sheets is generally not important, i.e., any length of sheet is generally acceptable. However, the sheets are preferably connected together such that the sheets are formed into one long, continuous length. In this manner, connected sheets may be provided in roll form, and a given length therefrom unwound for the desired use.

The embodiment of fiber-based materials 105 shown in FIG. 1 is toilet paper. Toilet paper is a tree-pulp based, fibrous material, and is substantially biodegradable. Sheets of toilet paper have typical dimensions of about 4 inches in length, 4 inches in width, and 0.5-5 millimeters in thickness (depending on the number of plies). Sheets of toilet paper are typically connected to one another by a perforation means, and are often provided in substantial length, e.g., about 50-100 ft. or greater, in roll form.

As shown in FIG. 1, the sheets of biodegradable, fiber-based material 105 have been wound about themselves into a generally oval shape. Such oval shape, as will be appreciated, generally corresponds to the shape of a toilet seat. The sheets have been wound in such a manner as to leave an interior, hollow portion that generally corresponds to the volume of mass occupied by a toilet seat. In this manner, the sheets may effectively provide a covering over the entire exterior surface of a toilet seat.

The procedure for winding the sheets into such shape and configuration may be performed as follows. A terminal end of a sheet is held firmly on the exterior surface of an object that roughly approximates the width and thickness of a toilet seat. Alternatively, a terminal end of a sheet is held firmly on the exterior surface of an object whose trans-axial perimeter is roughly equivalent to the trans-axial perimeter of a toilet seat, but that does not necessarily approximate the width and thickness of a toilet seat (i.e., such object could be cylindrical, etc.). In a preferred embodiment, the object is the toilet seat sought to be covered. In another preferred embodiment, the object is the user's own arm. From the point of firm contact with the object, the sheet is wound about the trans-axial perimeter of the object (clockwise or counterclockwise winding are both acceptable). Winding should be moderately tight with respect to the object, such that the resulting cover is integrally formed, however not so tight as to prevent subsequent removal from the object, as will be discussed in greater detail below. Winding is performed so as to skew along the axial direction of the object, i.e., each layer of winding only partially overlaps the previous layer, such that as winding progresses, coverage of the object progresses in an axial direction along the object (an example axial direction with respect to the oval shaped cover shown in FIG. 1 is shown as dashed line P). The amount of overlap of each wind determines how far axially the coverage progresses after each wind. For example, using a 4-inch wide sheet of toilet paper, and assuming 75% overlap on each wind (although in practice winding may overlap by a percentage of 5, 10, 15, 20, 25, 30, 35, 40, 45, 50, 55, 60, 65, 70, 75, 80, 85, 90, 95, or greater, or any range of percentages thereinbetween), the winding will skew axially (1-0.75)×4 in.=1 in. each revolution about the object; thus, coverage of the object progresses axially 1 in. for each wind. To fully cover a 20 in. long object, approximately 20 winds would be required. While the foregoing has been described with respect to simplified, non-mathematical terminology, it will be appreciated that principles of helical geometry are applicable to the winding procedure just described. See, e.g., E. W. Weisstein, "Helicoid," from MathWorld: available at http://mathworld.wolfram.com/Helicoid.html. Various calculations regarding surface area, curvature, etc. are available where more precise winding is desired.

Figure 2:
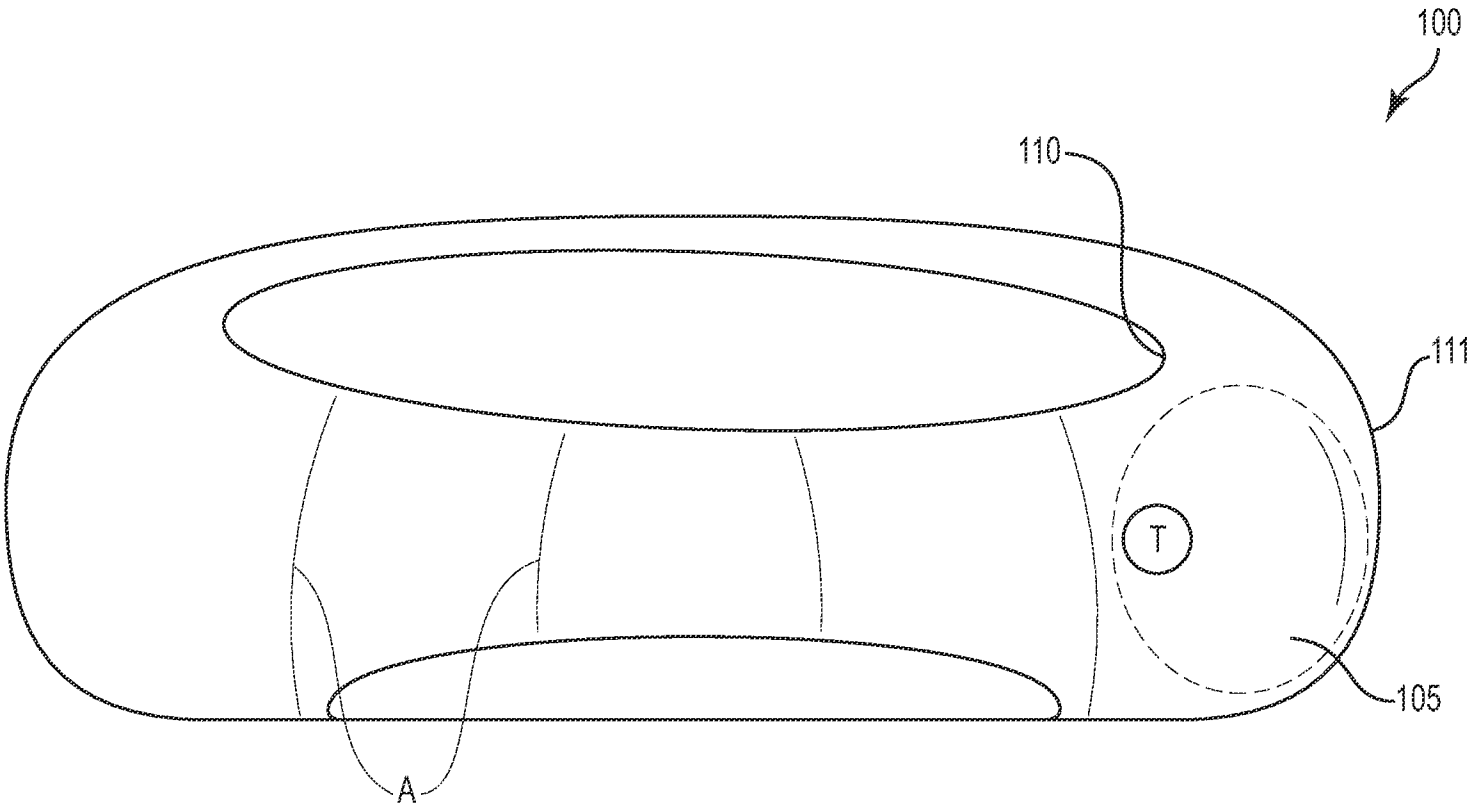
FIG. 2 illustrates a side view of the protective toilet seat cover embodiment of FIG. 1.

Once winding is completed to the desired axial length, what results is a wound, hollow cover with an interior trans-axial perimeter sufficient to enclose a toilet seat therewithin. An example of such interior trans-axial perimeter is shown in FIG. 2 as dashed line T. Where the object about which winding was performed was not the toilet seat on which the cover is to be used, the cover may be removed from the object, i.e., slid off of the object, and thereafter inserted onto the toilet seat. In either case, the toilet seat is substantially fully covered on all sides by the wound cover. It will also be appreciated that, even if the cover is formed about an object that is substantially straight axially (i.e., a cylinder), the flexibility of the fiber-based material, e.g., toilet paper, allows that resultant cover to bend and curve about the shape of the toilet seat as it is inserted thereover. Thus, it will be appreciated that the object need not conform to the shape (curvature) of a toilet seat for effective use in connection with the above-described procedures.

As shown in FIG. 1, the sheet of fiber-based material 105 forms a cover 100 in the shape of a toilet seat, defined by an interior perimeter 110 and an exterior perimeter 111. The overlap of the winds created during formation procedures of the cover are generally indicated by arrows "A", although the present disclosure should not be though of a limited to the particular winding pattern shown. In some embodiments, the cover 100 provides effective protection about substantially all of the surfaces of the toilet seat, although covers configured to protect only portions of the seat are certainly within the scope of the present disclosure.

FIG. 2 provides an illustration of the cover 100 looking into plane 2-2, as shown in FIG. 1. The width and thickness of the cover 100, substantially corresponding to the width and thickness of a toilet seat, become apparent from this view.

Figure 3:
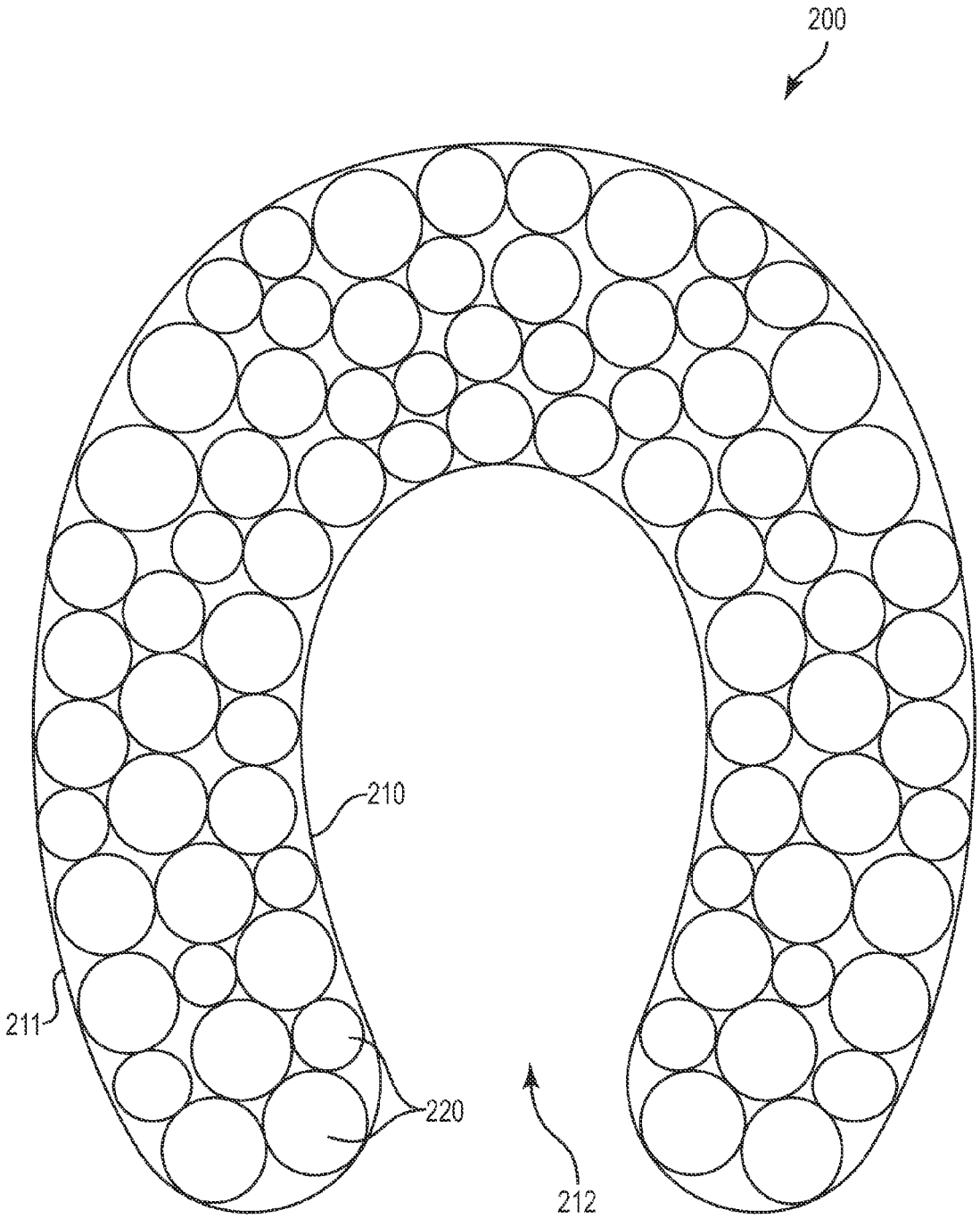
FIG. 3 illustrates a top of view a protective toilet seat cover accordance with another embodiment disclosed herein.

FIG. 3 illustrates another embodiment of the present disclosure. In this embodiment, the biodegradable, fiber-based material 200 is not provided in sheet form, but rather in "ball" form. (Note also that the shape is configured to cover an alternate toilet seat configuration, that is not fully oval, i.e., the cover 200 has inner edge 210, outer edge 211, and open portion 212). Such balls 220 may be made of any of the biodegradable, fiber-based materials described above. In a preferred embodiment, the balls are cotton balls.

Balls 220 may generally be provided in any size and shape, including, but not limited to, substantially spherical, cylindrical, elliptical, rectangular, cubic, parallelepiped, irregular, etc. Dimensions may vary depending on the shape (i.e., length, width, thickness, radius, perimeter, diameter (major or minor), etc.), but will generally be about 0.01, 0.05, 0.1, 0.2, 0.3, 0.4, 0.5, 0.6, 0.7, 0.8, 0.9, 1., 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.5, 4, 4.5, 5, 6, 7, 8, 9, 10 or greater centimeters, or within any range of dimensions thereinbetween. In a preferred embodiment, generally spherical cotton balls are provided having a diameter between about 0.5 and 1.5 inches.

In some embodiments, balls 220 may be attached to, adhered to, or otherwise connectedly associated with a substrate. (Adhesive, sewing, or other physical connecting means may be required to make such connected association). Balls may be connected thereto in abutting adjacency with one another along the entire exterior surface of the substrate, as shown in FIG. 3 (or optionally only portions thereof). The substrate may be provided in the shape of a toilet seat (in two or three dimensions, with a two dimensional substrate configured for placement atop a toilet seat and a three dimensional substrate configured for insertion over a toilet seat), such that when the balls 220 are connectedly associated therewith, a toilet seat cover is formed in the manner of cover 200. In this manner, the balls, connected with the substrate, can be easily provided on and removed from a toilet seat cover in an integral fashion, such that the balls do not separate from one another and scatter as the cover is manipulated in place. Suitable substrates are preferably biodegradable, fiber-based materials as well. In one embodiment, the substrate is a paper-based material sheet provided in the shape of a toilet seat. In another embodiment, the substrate is a paper-based material in three dimensions configured to be inserted over a toilet seat, in much the same manner as the wound cover of FIGS. 1 and 2. In a further embodiment, the substrate is a cover in accordance with the embodiment of FIGS. 1 and 2. Other shapes and configurations of substrates are possible.

In a further embodiment (not specifically illustrated in any of the figures), the cover may be provided as a hybrid between the embodiments of FIGS. 1 (wound sheet cover) and 3 (balls on substrate cover). In this embodiment, sheet winding is performed substantially as described above with regard to FIG. 1, except that a plurality of balls are placed within (i.e., between) the overlapping portions of the sheet layers as winding progresses axially along the object. In this manner, the balls are held in place by the "sandwich" effect created between overlapping layers, and therefore may not require the same physical connection means discussed above with regard to FIG. 3 (although it is certainly possible to use such means as well).

The environmental benefits of the embodiments described herein are manifest. By using as toilet seat covers biodegradable materials, for example, biodegradable fiber-based materials, as opposed to non-biodegradable polymers (as are known in the art), the presently described embodiments do not harm nature by contributing to non-biodegradable waste. Thus, such seat covers can be configured for single-use (although they may certainly be re-used), with their disposal after use not contributing permanent waste.

A further benefit of the presently disclosed embodiments is the ubiquity of the materials from which they are made, and their ease of construction. For example, a situation commonly encountered is where a person goes to use a public toilet, but discovers that only polymer-based, non-biodegradable seat covers are provided for use. This person, desirous of not harming the environment, but at the same time desirous of the protection that toilet seat covers provide, may utilize the presently described systems and methods for protection as toilet paper is usually readily available at public toilets, and all one needs is their own arm (as described above) to properly configure the protective seat cover. In this manner, the person gains the benefit of hygienic protection whilst using a public toilet, and does so in a manner that does not harm the environment by producing excess, non-biodegradable waste.

It is also anticipated that embodiments of the present disclosure can be used at home, i.e., in using a private toilet in one's home, or at other locations that are neither wholly public nor wholly private, i.e., a rented hotel room, a penal institution, etc. In the example of a hotel room, there is no way a person can be assured that the housekeeping staff completely cleaned their room's toilet after the previous occupant vacated. Thus it may be desirable to use the devices and methods of the present disclosure for protection. It will be appreciated that toilet paper and cotton balls are readily available commodities in the hotel setting. In the example of a penal institution (i.e., jail, prison, or other involuntary detention facility), a person may be required to use a toilet in one's cell, or other toilet area, where one or more other persons may have access to the use of such toilet. Thus, it may be desirable to use the devices and methods of the present disclosure for protection. Other uses in other settings are of course possible.

While the present disclosure has been presented with regard to preferred embodiments using biodegradable materials, i.e., fiber-based biodegradable materials in the form of toilet paper or cotton balls, it will be appreciated that any biodegradable material (which may be fiber-based) may be used, in any shape or configuration beyond balls or sheets—for example, pads, folded sheets, threads, clusters, or even amorphous materials, etc. All such configurations may be suitable for providing the protection described herein, in an environmentally responsible manner.

As used herein, the terms "front," "back," and/or other terms indicative of direction are used herein for convenience and to depict relational positions and/or directions between the parts of the embodiments. It will be appreciated that certain embodiments, or portions thereof, can also be oriented in other positions.

In addition, the term "about" should generally be understood to refer to both the corresponding number and a range of numbers. In addition, all numerical ranges herein should be understood to include each whole integer within the range. While an illustrative embodiments have been disclosed herein, it will be appreciated that numerous modifications and other embodiments may be devised by those skilled in the art. Therefore, it will be understood that the appended claims are intended to cover all such modifications and embodiments that come within the scope defined by the claims.

Although the present disclosure has been described with reference to various embodiments, persons skilled in the art will recognize that changes may be made in form and detail without departing from the spirit and scope of the disclosure.

What is claimed is:

1. A seat cover comprising a sheet of biodegradable material in the form of an overlapping, helical geometry winding that defines a hollow core, the hollow core having an interior perimeter sufficiently large so as to fully encompass a toilet seat about a trans-axial perimeter thereof when inserted over the toilet seat.

2. The seat cover of claim 1, wherein the biodegradable material comprises a plant-based fiber material.

3. The seat cover of claim 1, wherein the biodegradable material comprises toilet paper.

4. The seat cover of claim 1, wherein the helical geometry winding of the sheet is wound in a substantially trans-axial direction with respect to the length of the toilet seat.

5. The seat cover of claim 1, wherein a wind of the of the helical geometry winding partially overlaps a preceding wind.

6. The seat cover of claim 5 comprising a plurality of partially overlapping winds so as to give the cover a length in an axis direction.

7. The seat cover of claim 6, wherein the length is sufficiently long to substantially cover the toilet seat along its axial length.

8. A seat cover comprising a plurality of biodegradable, fiber-based balls physically connected onto a substrate, wherein the substrate comprises a paper-based material sheet and has substantially the shape of a toilet seat.

9. The seat cover of claim 8, wherein the biodegradable balls comprise a plant-based fiber material.

10. The seat cover of claim 9, wherein the biodegradable balls comprise cotton balls.

11. The seat cover of claim 8, wherein the substrate is two dimensional and configured for placement atop the toilet seat.

12. The seat cover of claim 8, wherein the substrate is three dimensional and configured for insertion over a toilet seat.

13. The seat cover of claim 8, wherein the substrate comprises a biodegradable material.

14. The seat cover of claim 8, wherein the balls are positioned in abutting adjacency with respect to one another along the exterior surface of the substrate.

15. A method of making a seat cover, comprising:

winding a sheet of biodegradable material about an object having a trans-axial perimeter about the same size as a toilet seat, wherein a wind partially overlaps a preceding wind such that winding progresses helically in an axial direction along the object with each successive wind; and removing the wound sheet from the object.

16. A method of using a seat cover made by the method of claim 15 comprising inserting the wound sheet over a toilet seat so as to cover the toilet seat fully about a trans-axial perimeter thereof.

17. The method of claim 15, wherein the sheet of biodegradable material comprises toilet paper.

18. The method of claim 15, wherein the object has a shape and size similar to a human arm.

19. A method of making a seat cover comprising physically connecting a plurality of biodegradable, fiber-based balls onto a paper-based material sheet substrate along an exterior surface thereof, wherein the substrate has the shape of a toilet seat.

20. A method of using a seat cover made by the method of claim 19 comprising placing the cover atop a toilet seat if the substrate has a two-dimensional form or inserting the cover over a toilet seat if the substrate has a three-dimensional foam.

21. The method of claim 19, wherein the balls are cotton balls.

* * * * *

UNITED STATES PATENT AND TRADEMARK OFFICE

CERTIFICATE OF CORRECTION

PATENT NO. : 8,973,175 B2
APPLICATION NO. : 13/165447
DATED : March 10, 2015
INVENTOR(S) : Green It is certified that error appears in the above-identified patent and that said Letters Patent is hereby corrected as shown below:

In the Claims,

| Column | Line | Claim | Line | PTO | Should Be |
|---|---|---|---|---|---|
| 8 | 21 | 20 | 4 | "three-dimensional foam." | -- three-dimensional form. -- |

Signed and Sealed this
Thirtieth Day of June, 2015

Michelle K. Lee

Michelle K. Lee
*Director of the United States Patent and Trademark Office*